US011446932B2

(12) United States Patent
Butinya

(10) Patent No.: US 11,446,932 B2
(45) Date of Patent: Sep. 20, 2022

(54) PRIMERS FOR PRINT HEADS

(71) Applicant: HEWLETT-PACKARD DEVELOPMENT COMPANY, L.P., Spring, TX (US)

(72) Inventor: David Butinya, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 246 days.

(21) Appl. No.: 16/347,128

(22) PCT Filed: Mar. 31, 2017

(86) PCT No.: PCT/US2017/025284
§ 371 (c)(1),
(2) Date: May 2, 2019

(87) PCT Pub. No.: WO2018/182674
PCT Pub. Date: Oct. 4, 2018

(65) Prior Publication Data
US 2020/0070535 A1 Mar. 5, 2020

(51) Int. Cl.
*B41J 2/175* (2006.01)
*B41J 2/165* (2006.01)

(52) U.S. Cl.
CPC ..... *B41J 2/17596* (2013.01); *B41J 2/17556* (2013.01); *B41J 2002/16594* (2013.01)

(58) Field of Classification Search
CPC ..... B41J 2/16526; B41J 2/1707; B41J 2/175; B41J 2/17596; B41J 2/17556; B41J 2/18
See application file for complete search history.

(56) References Cited

U.S. PATENT DOCUMENTS 5,812,168 A * 9/1998 Pawlowski, Jr ..... B41J 2/175 347/85
5,847,734 A * 12/1998 Pawlowski, Jr. ..... B41J 2/1707 347/86
5,870,126 A 2/1999 Kondo et al.
5,980,018 A 11/1999 Taylor et al.
6,290,343 B1 * 9/2001 Lewis ..... B41J 2/175 347/85
6,302,516 B1 10/2001 Brooks et al.
6,419,343 B1 * 7/2002 Taylor ..... B41J 2/16526 347/23
7,111,917 B2 9/2006 Hill et al.
7,455,399 B2 11/2008 Senior et al.
(Continued)

FOREIGN PATENT DOCUMENTS

CN 1344620 4/2002
CN 2645906 10/2004
(Continued)

*Primary Examiner* — John Zimmermann
(74) *Attorney, Agent, or Firm* — HP Inc. Patent Department

(57) ABSTRACT

A primer apparatus for a print head structure of an inkjet printer, in which the primer apparatus comprises a pump to supply a flow of air to the print head structure, an outlet valve and a control valve in fluid communication with and disposed between the pump and the outlet valve, the outlet valve comprising a venting structure to reduce the pressure of a flow of air supplied to the print head structure when the control valve is open.

20 Claims, 9 Drawing Sheets

(56) References Cited

U.S. PATENT DOCUMENTS

| | | | | |
|---|---|---|---|---|
| 7,484,837 | B2 * | 2/2009 | Koga | B41J 2/17509 347/85 |
| 7,762,656 | B2 | 7/2010 | Snyder | |
| 7,887,167 | B2 | 2/2011 | Comas | |
| 8,356,877 | B2 | 1/2013 | Lebron et al. | |
| 8,814,319 | B2 * | 8/2014 | Lebron | B41J 2/17556 347/22 |
| 9,168,752 | B2 | 10/2015 | Ros Cerro et al. | |
| 2007/0195136 | A1 | 8/2007 | Senior | |
| 2009/0244172 | A1 | 10/2009 | Snyder | |
| 2015/0109367 | A1 | 4/2015 | Ros Cerro et al. | |

FOREIGN PATENT DOCUMENTS

| | | |
|---|---|---|
| CN | 103038064 | 4/2013 |
| CN | 202847112 | 4/2013 |
| EP | 0780232 | 6/1997 |
| JP | S5959455 | 4/1984 |
| JP | H11291519 | 10/1999 |
| JP | 2009234263 | 10/2009 |
| WO | WO-2010019132 | 2/2010 |

* cited by examiner (c)

(d)

PRIMERS FOR PRINT HEADS

BACKGROUND

In a printing apparatus, such as n ink jet printing apparatus for example, a primer may be used for print head cleaning and maintenance routines or for print fluid recirculation. For example, print head servicing may be performed to improve or maintain good print head nozzle health. Recirculation of a print fluid may be performed to prevent or reduce pigment settling for example.

BRIEF DESCRIPTION OF THE DRAWINGS

Various features of certain examples will be apparent from the detailed description which follows, taken in conjunction with the accompanying drawings, which together illustrate, by way of example only, a number of features, and wherein.

DETAILED DESCRIPTION

Figure 1A:
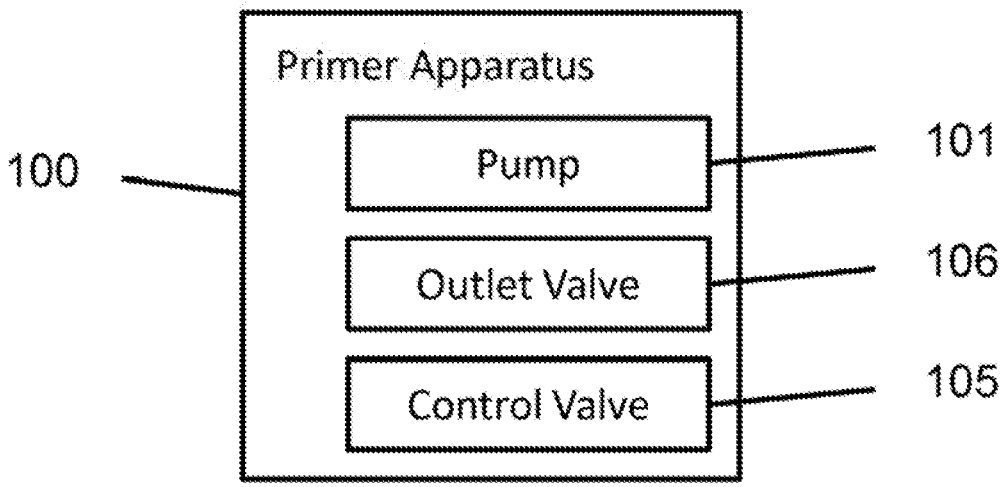
FIGS. 1*a* and 1*b* are schematic representations of a primer apparatus according to an example.

In the following description, for purposes of explanation, numerous specific details of certain examples are set forth. Reference in the specification to "an example" or similar language means that a particular feature, structure, or characteristic described in connection with the example is included in at least that one example, but not necessarily in other examples.

A primer apparatus for a print head structure of, for example, an inkjet printer can be used to provide a pressurised flow of air. This can be used for print head servicing (or purging of a print head) or print fluid recirculation, such as in a macro-recirculation enabled print head for example. A print head structure can be used in a two-dimensional or three-dimensional printer.

The primer pressure used for servicing or purging of a print head can be relatively high (of the order of e.g. 35 kPa, 5 psi) whereas the pressure used for enabling recirculation in a macro-recirculation enabled print head can be relatively low (of the order of e.g. 14 kPa, 2 psi). Thus, in a system where the same pressure is used or available, a trade-off is to be made between either lower pressure, in which case servicing is not as effective, or higher pressures, in which case each time that recirculation is enabled there can be drooling on the nozzles of a print head for example because of the backpressure going positive.

To obtain different air pressures, a pump can be activated for different durations. For example, as air pumps have an increasing pressure curve, higher pressures can be reached by activating them for longer. However, there can be a large variability between air pumps, so the same amount of pump activation time may not give the same pressure in two different printing systems.

When performing servicing routines, this can lead to inconsistent results when cleaning nozzles or purging a print head. When enabling recirculation through a print head, if the pressure is not well adjusted, it can create a pressure that is not high enough to open a regulator and so there will not be recirculation. However, if the pressure is too high, ink can drool through, the print head nozzles. Furthermore, activating an air pump for different durations may not provide a steady pressure for a low-pressure mode and so it is not possible to maintain the same pressure for a specific time (e.g. to activate the primer pressure at 14 kPa for 3 seconds).

As an alternative to varying the activation duration of an air pump, it may be controlled using a Pulse Width Modulation (PWM) technique to vary the power supplied to the pump. That by activating the pump at different PWM percentages, different air pressures can be obtained. However, as above, there can be a performance variability between pumps. For example, running two pumps at 50% power for 1 second can give different pressures for each pump. Furthermore, any control system of a printing apparatus should be able to use a PWM pump control, which is not always the case. That is, boards (printed circuit control boards for example) used in primer devices may not include the facility for PWM control. In addition, a PWM controlled pump may not reach a steady state. For example, in the presence of a relief valve the steady state may be only achieved for a high-pressure mode.

According to an example, a primer apparatus comprises a pump to supply a flow of air to a print head structure, an outlet valve and a control valve in fluid communication with and disposed between the pump and the outlet valve, the outlet valve comprising a venting structure to reduce the pressure of a flow of air supplied to the print head structure when the control valve is open. The control valve can be a normally open (NO) solenoid valve comprising two ports (inlet and outlet) for example. In general, any valve having at least two ports can be used to open or close the circuit. For example, a bi-stable valve can be used. In addition, a relief valve can be provided.

FIG. 1*a* is a schematic representation of a primer apparatus according to an example. A primer apparatus 100 is shown comprising a pump 101, an outlet valve 106 and a control valve 105.

Figure 1B:
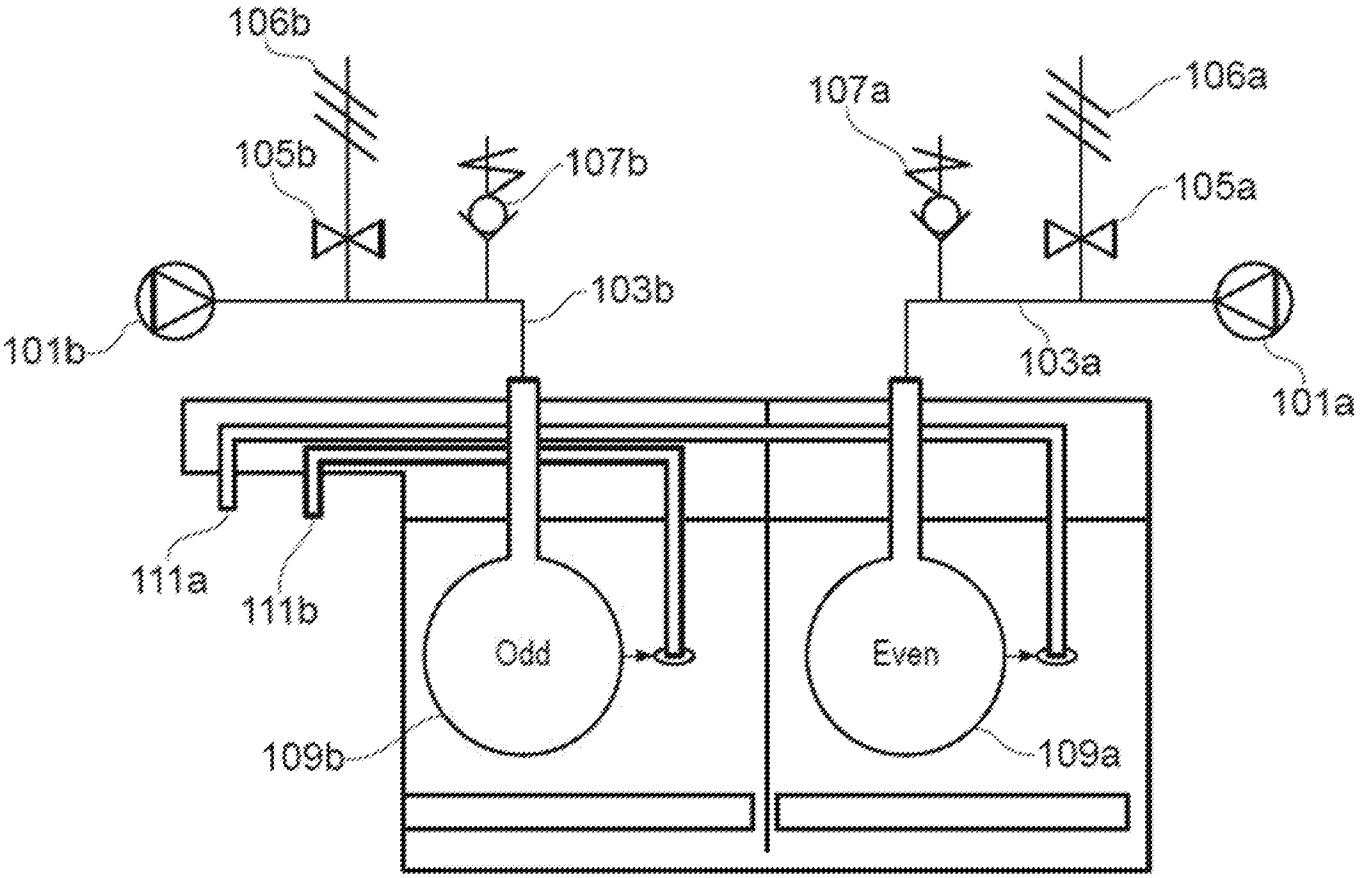

FIG. 1*b* is a schematic representation of a primer apparatus according to an example. An air pump 101*a* can provide a positive air pressure within a conduit or pipe 103*a* when activated. A control valve 105*a*, such as an NO solenoid valve and an outlet valve 106*a* are connected in series and are provided in fluid communication with each other, the pump 101*a* and the atmosphere.

A relief valve 107*a* can be provided to control or limit the pressure in the system to a predefined maximum. In the example of FIG. 1*b*, excess pressure above a predetermined threshold pressure can be relieved/released using the relief valve 107*a* by allowing the pressurised air to flow therefrom. In general, relief valve 107*a* will self-vent when a threshold pressure is exceeded, thereby maintaining a steady pressure at or just below the threshold value of the relief valve.

Two such primer apparatus may be provided, each serving respective different sub-sets of multiple print heads of a printing apparatus. A second such apparatus is shown in FIG. 1*b* and has the same components as that described above with the label 'a' replaced by 'b' although it will be appreciated that one or more than two such apparatus may be provided.

According to an example, outlet valve 106*a* comprises a venting structure to reduce the pressure of a flow of air supplied to a print head structure via conduit 111*a* when the control valve 105*a* is open and the air pump 101*a* is activated.

The venting structure can comprise an obstruction to impede a flow of air through the outlet valve. In an example, the venting structure is a plug or plug-type obstruction in the outlet valve that is in fluid communication with the atmosphere. The obstruction creates a pressure differential as air flows through it resulting in a reduction in the pressure flowing in the apparatus. Accordingly, an air flow may be supplied to a print head at one of two different pressures—a relatively higher pressure in the case that the control valve 105*a* is closed (up to a maximum pressure defined by the working pressure of the relief (or release) valve 107*a*) and a relatively lower pressure in the case that the control valve 105*a* is open and which is defined by operation of the outlet valve 106*a*.

In an example, an obstruction, such as a plug, in the outlet valve 106*a* has a geometry that creates a high pressure drop as an air flow passes through the valve 106*a* when the control valve 105*a* is open and the air pump 101*a* is activated. In an example, a sinuous channel can be provided on a surface of the plug, which impedes the flow of air through the valve 106*a*. Other channel shapes can be used. For example, a zig-zag shape or a helical channel can be used. In an example, there can be one or more distinct channels around the outside edge or through an interior of the plug. For example, a helical or spiral channel can be provided in the interior of the plug or obstruction. In an alternative example, a porous material could be used as the obstruction with a porous diameter sufficient to create a pressure drop. If there is no air flow (idle position), the pressure on both sides of the valve 106*a* will be the same, namely atmospheric pressure.

By modifying the state of the air pump (on or off) and the control valve (open or closed), a single primer apparatus can supply an air flow at pressures that are suitable for maintenance and recirculation in a print apparatus. That is, two different pressure air flows can be generated by one apparatus.

According to an example, combinations to achieve different pressures in the regulators 109*a*, 109*b* depending on the state of the components activated are as follows:

| Air Pump (101a, 101b) | Control Valve (105a, 105b) | Pressurisation Mode |
|---|---|---|
| OFF | OFF (open) | No pressurisation - atmospheric pressure |
| ON | ON (closed) | High pressurisation mode |
| ON | OFF (open) | Low pressurisation mode |

Therefore, according to an example, to activate a high pressurization mode, both the control valve 105*a* (105*b*) and the air pump 101*a* (101*b*) are activated. After an initial pressurization ramp, the pressure will reach the relief valve 107*a* (107*b*) pressure thereby causing it to vent. At this point the pressure will be maintained at a value that corresponds to the relief pressure of the valve 107*a* (107*b*).

For a low pressurization mode, only the air pump 101*a* (101*b*) is activated. In doing so, the regulator 109*a* (109*b*) is pressurized but air flows through the outlet valve creating a pressure drop between the inlet and outlet ports of the outlet valve. This creates a steady pressure that is below that of the configuration in which the control valve 105*a* (105*b*) is activated (i.e. closed).

In both pressurization modes (high and low), the pressure achieves a steady state after an initial pressure ramp as the pressure builds (in the high-pressure mode because of the relief valve and in the low pressure mode because of the outlet valve). These two pressures can be adjusted when designing the primer apparatus (e.g. selecting a relief valve with a higher opening pressure), but once manufactured, all will have the same or very similar performance. Thus, the duration of activation of the air pump is not a consideration.

Furthermore, a primer apparatus according to an example may be compatible with printed circuit boards (PCBs) found in printing apparatus that use other primer devices since the existing control mechanisms can activate the control valve and air pump independently.

According to an example, because of the outlet valve, during a low-pressure mode activation, the pressure ramp will have a smaller slope (there is a flow through the venting structure that reduces the pressure slope when pressurizing). Accordingly, during this mode, the air pressure can be used to inflate or pressurize a regulator, such as a bag for example, in order to enable print fluid (such as ink) recirculation through a print head. Having a gentler (that is, smaller) pressure ramp without pressure spikes can prevent ink drooling through the nozzles at a print head which can be caused when there is a large pressure slope or a pressure spike.

Figure 2:
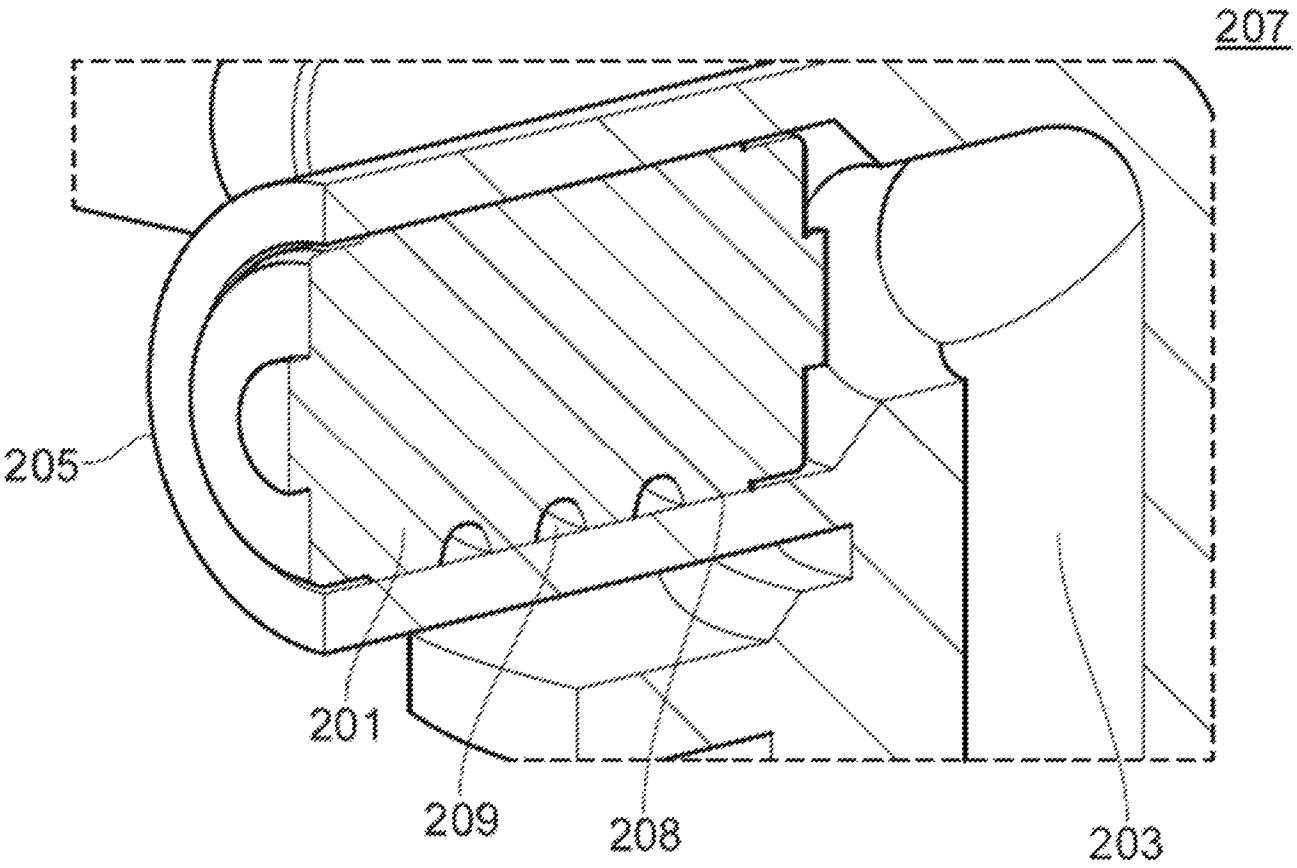
FIG. 2 is a schematic representation of a venting structure according to an example.

FIG. 2 is a schematic representation of a venting structure according to an example. More specifically, FIG. 2 is a cross-sectional view of a venting structure in an outlet valve according to an example. In the example of FIG. 2, the venting structure presents an obstruction 201 in the part of the outlet valve that vents to the atmosphere. At the interface 208 between the inside surface of the outlet 205 and the outside of the obstruction, a channel 209 is provided. The channel is in fluid communication with the atmosphere and the conduit 103*a* (103*b*) via the control valve 105*a* (105*b*). Thus, air from the air pump can flow through the channel from an inlet side 203 of the obstruction to an outlet side 205. Air passing through the channel can therefore vent from the inlet side 203 to the outlet side 205 where it passes to the atmosphere.

With reference to FIG. 1*b*, the inlet side 203 receives an air flow from the conduit 103*a* (103*b*) when the control valve 105*a* (105*b*) is off (open). As an air flow passes through the channel in the venting structure to the atmosphere, a pressure drop is created between the inlet side 203 and the outlet side 205 as a result of the structural configuration of the obstruction, which reduces the flow of air through the valve 207 from the inlet side 203 to the outlet side 205.

In the example shown in FIG. 2, the obstruction 201 is in the form of a plug. The plug can be maintained in place using an interference fit, by being adhered to the outlet valve or alternatively by being integrally moulded with the valve 207. In the example of FIG. 2, the channel 209 takes a sinuous path over the outside of the obstruction thereby forming an elongate winding conduit 209 through which air can flow. The channel 209 presents an impediment to the flow of air to the atmosphere and thus provokes the formation of a pressure differential between the inlet side 203 and the outlet side 205 of the valve 207. That is, a reduction in the pressure of an air flow is created as the air flow passes through the channel 209.

In the example of FIG. 2, the dimensions of the channel are approximately 0.5 mm×0.4 mm and the length of the channel across the length plug is approximately 24 mm. The turns, which are 180° (and smooth turns), create additional resistance to air flow.

The channel 209 (or channels if there are more than one) does not have to be on the outer surface of the plug. In an example, a channel or channels can be defined within the plug.

The reduction in pressure between the two sides (inlet/outlet) of the outlet valve 207 creates a steady pressure that is lower than the pressure of an air flow in the primer apparatus when the control valve 105*a* (105*b*) is activated (i.e. closed). Such a steady, relatively lower pressure, air flow can be used for recirculation of print fluids. With the control valve activated, the resultant relatively higher pressure is suitable for print head servicing, as noted above.

FIGS. 3*a-d* are schematic representations of a plug according to an example. FIG. 3*a* shows a plug according to an example from one side, and FIG. 3*b* is a schematic representation of the plug of FIG. 3*a* shown from another side in order to enable visualisation of the channel geometry. The channel 209 is visible in both figures along with the entrance 303 and exit 301 from the channel.

FIG. 3*c* shows the plug of FIGS. 3*a* and 3*b* from another side, in which the channel is visible and FIG. 3*d* is a perspective view of the plug of FIGS. 3*a-c*.

Figure 3:
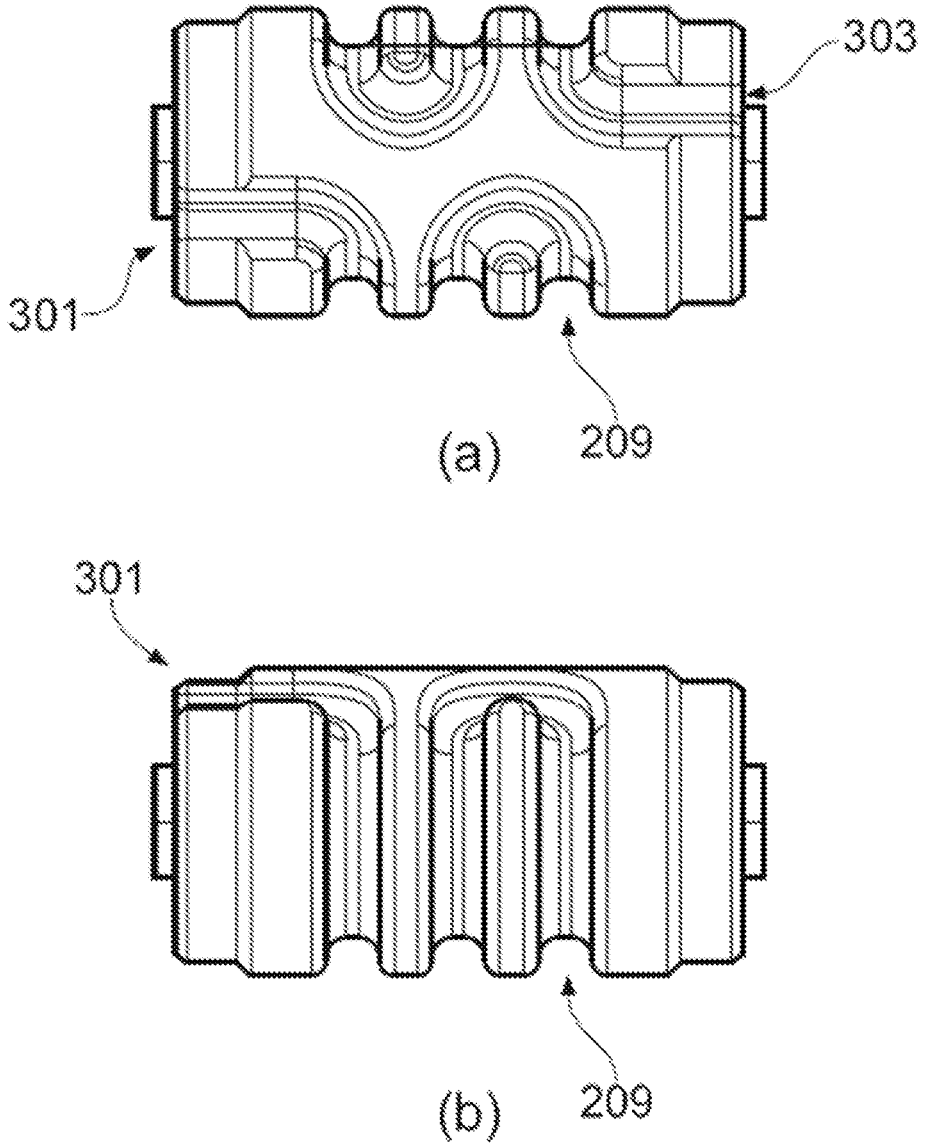
FIGS. 3*a* to 3*d* are schematic representations of a plug according to an example.
Figure 3:
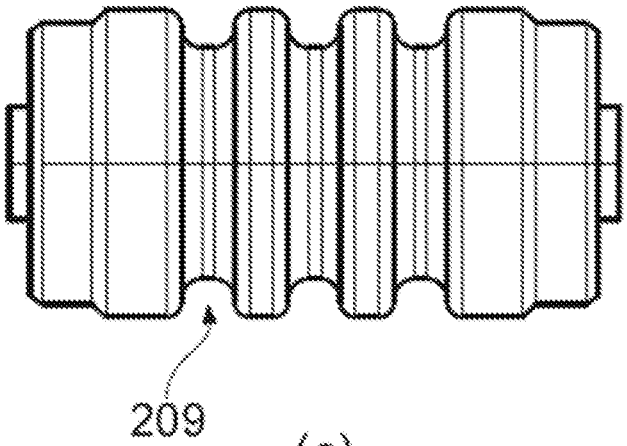
Figure 3:
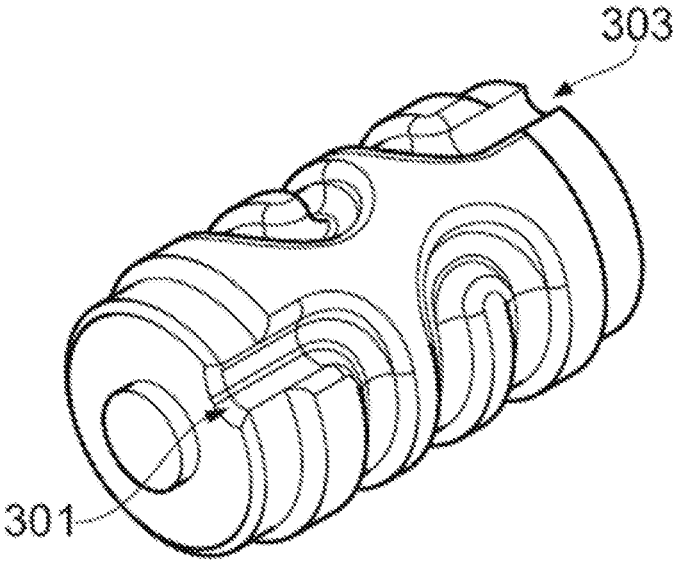

As noted above, the channel (or channels) geometry may be different, and a channel (or channels) can be provided in the interior of the obstruction and/or on the outside as is depicted in FIG. 3.

Figure 4A:
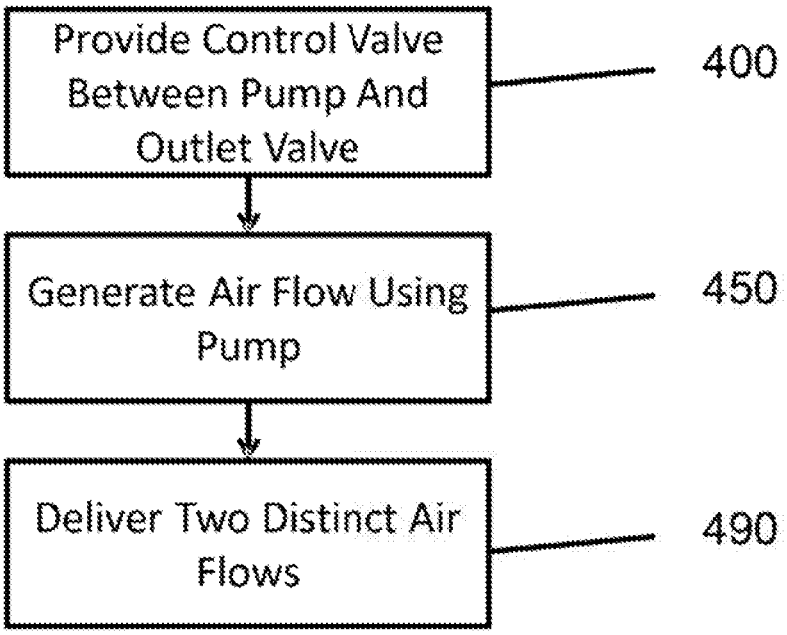
FIGS. 4*a* to 4*d* are flow charts of a method according to an example.
Figure 4B:
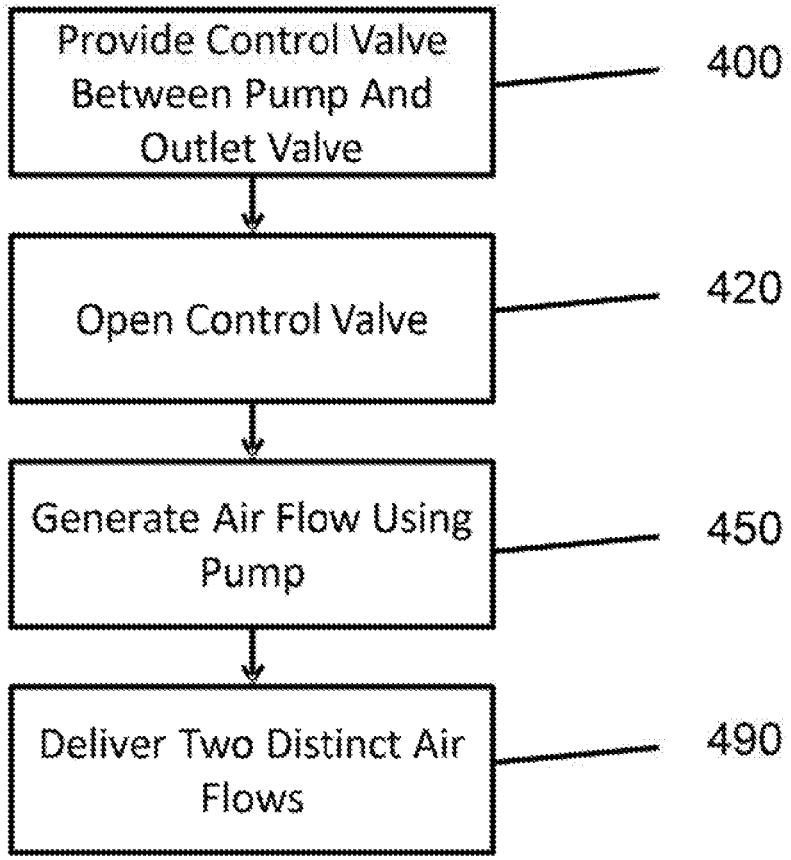
Figure 4C:
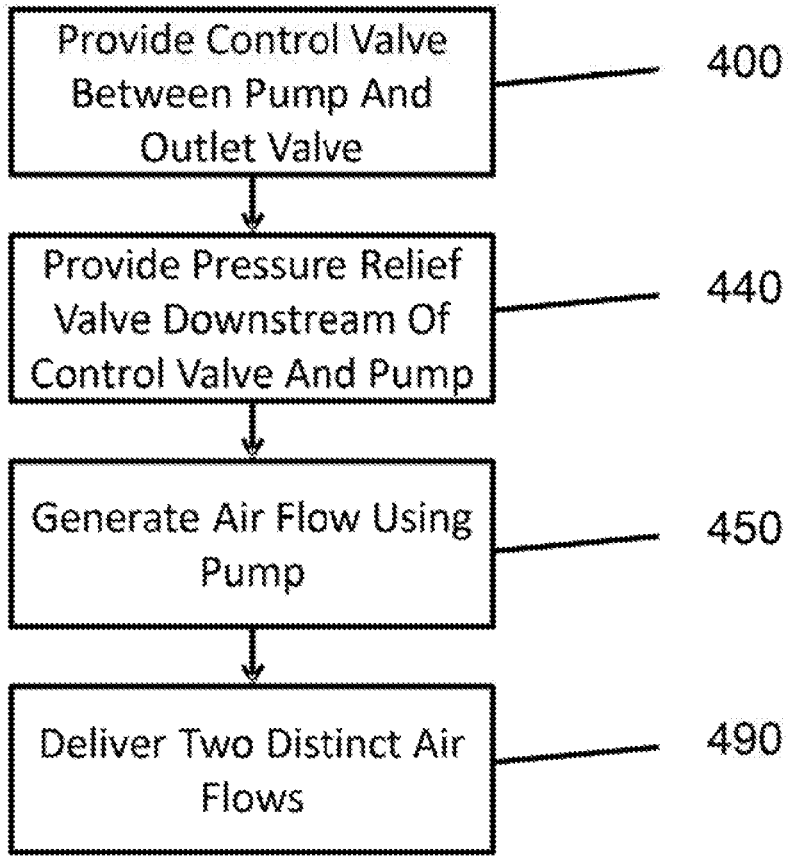
Figure 4D:
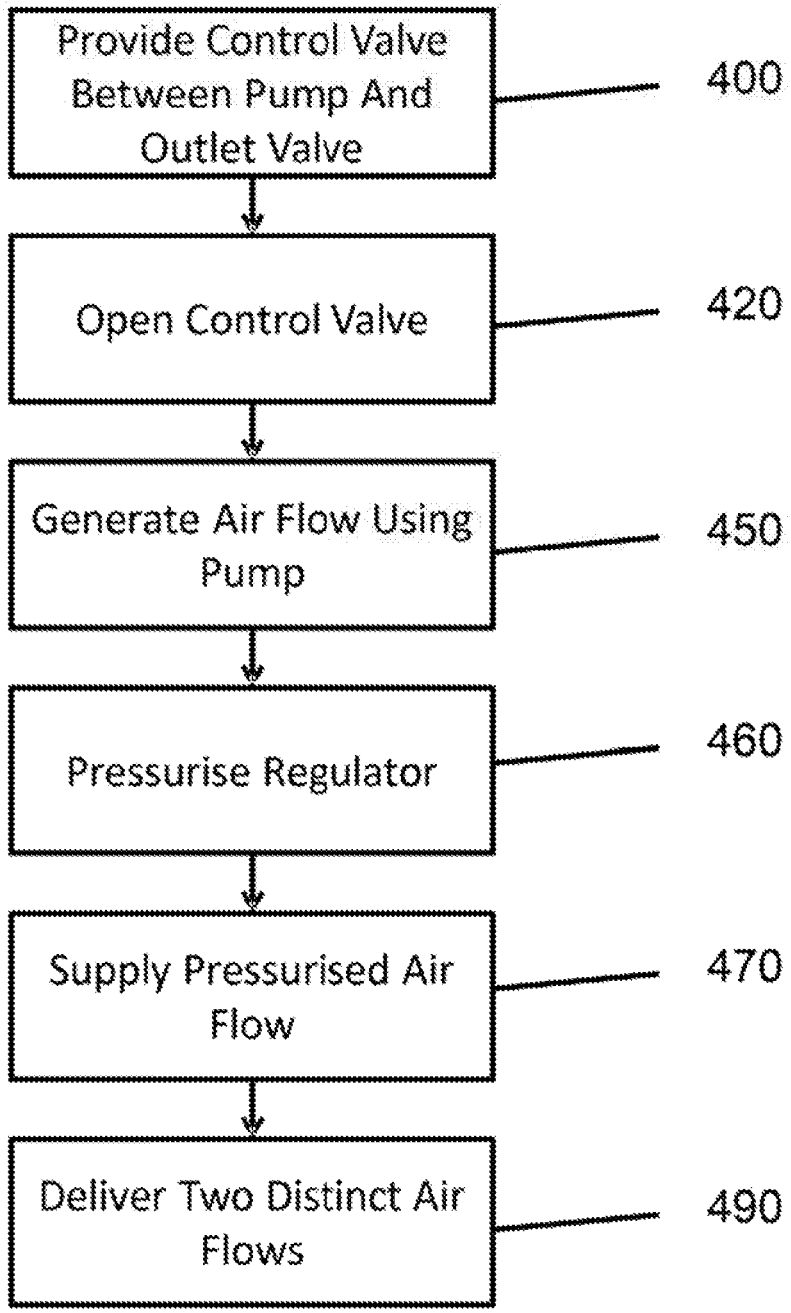

FIGS. 4*a* to 4*d* show flow charts of a method according to an example. In FIG. 4*a* is shown a method of delivering two distinct air flows in a primer apparatus for a print head structure. At block 400 a control valve is provided in fluid communication with and disposed between the air pump and outlet valve of the primer apparatus. The outlet valve comprises the venting structure to reduce the pressure of a flow of air supplied to the print head structure. At block 450 an air flow is generated using the air pump. At block 490 at least two distinct pressurised air lows in the primer apparatus are delivered to the print head structure. FIG. 4*b* comprises an additional step of opening the control valve at block 420, whereby to enable a proportion of the air flow to pass or bleed trough the venting structure of the outlet valve. FIG. 4*c* comprises the step of providing a pressure relief valve in fluid communication with and disposed downstream of the control valve and air pump at block 440. FIG. 4*d* shows a flow chart comprising the steps of providing a control valve between an air pump and outlet valve at block 400, opening the control valve at block 420, generating an air flow using the air pump at block 460, pressurising a regulator at block 460, supplying a pressurised air flow at block 470 and delivering two distinct air flows at block 490.

Figure 5:
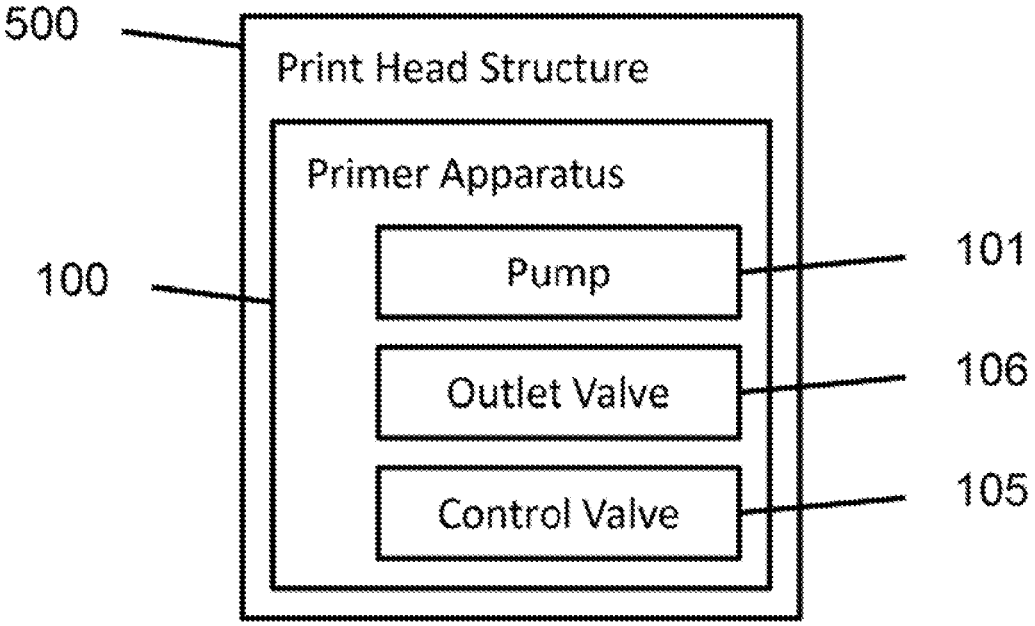
FIG. 5 is a schematic representation of a print head structure according to an example.

FIG. 5 is a schematic representation of a print head structure 500 comprising a primer apparatus 100 according to an example.

While the method, apparatus and related aspects have been described herein with reference to certain examples, various modifications, changes, omissions, and substitutions can be made without departing from the spirit of the present disclosure. In particular, a feature or block from one example may be combined with or substituted by a feature/block of another example. Furthermore, although reference is made herein to an air flow and air pump and so on, it will be apparent that any gaseous or fluid substance may be used.

The word "comprising" does not exclude the presence of elements other than those listed in a claim "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A primer apparatus for a print head structure of an inkjet printer, the primer apparatus comprising:

a pump to supply a flow of air to the print head structure;

an outlet valve; and a control valve in fluid communication with and disposed between the pump and the outlet valve, the outlet valve comprising a venting structure to reduce the pressure of a flow of air supplied to the print head structure when the control valve is open.

2. A primer apparatus as claimed in claim 1, wherein the venting structure comprises an obstruction in the outlet valve, the obstruction comprising a channel in fluid communication with the atmosphere and the control valve.

3. A primer apparatus as claimed in claim 2, wherein the channel is an elongate winding or sinuous conduit defined at an interface between an inside surface of the outlet valve and an outside surface of the obstruction.

4. A primer apparatus as claimed in claim 2, wherein the obstruction is a plug that is maintained in the outlet valve by interference fit or by being adhered in the outlet valve or that is integrally moulded with the outlet valve.

5. A primer apparatus as claimed in claim 1, further comprising a pressure relief valve in fluid communication with and disposed downstream of the control valve.

6. A primer apparatus as claimed in claim 5, wherein the pressure relief valve has a release pressure greater than the pressure of the flow of air when the control valve is open.

7. A primer apparatus as claimed in claim 2, wherein the obstruction is formed from a porous material.

8. A method for delivering at least two distinct pressurised air flows in a primer apparatus for a print head structure of an inkjet printer, the method comprising:

generating an air flow using a pump;

providing a control valve in fluid communication with and disposed between the pump and an outlet valve of the primer apparatus, the outlet valve comprising a venting structure to reduce the pressure of a flow of air supplied to the print head structure by the pump;

when the control valve is closed, supplying a first pressure to the print head structure that purges the print head structure; and when the control valve is open, supplying a second, lower pressure to the print head structure that circulates fluid through the print head structure.

9. A method as claimed in claim 8, further comprising:

operating the control valve with a normally-open solenoid, wherein, when the solenoid is inactive and open a proportion of the air flow passes through the venting structure of the outlet valve.

10. A method as claimed in claim 8, further comprising;

when supplying the second pressure, pressurising a regulator; and supplying a pressurised air flow from the regulator to the print head structure, whereby to enable print fluid recirculation.

11. A method as claimed in claim 9, further comprising:

bypassing the outlet valve by activating the solenoid of the control valve.

12. A method as claimed in claim 8, further comprising;

when supplying the first pressure, pressurising a regulator; and supplying a pressurised air flow from the regulator to the print head structure, whereby to enable print head maintenance or servicing.

13. A method as claimed in claim 8, further comprising:

providing a pressure relief valve in fluid communication with and disposed downstream of the control valve and the air pump.

14. A print head structure for an inkjet printer, the print head structure including a primer apparatus comprising:

a pump to supply a flow of air to the print head structure;

an outlet valve; and a control valve that is switchable between a closed state and an open state, the control valve in fluid communication with and disposed between the pump and the outlet valve, the outlet valve comprising a venting structure to reduce the pressure of a flow of air supplied to the print head structure when the control valve is open;

the primer apparatus having a priming mode, in which a first pressure is supplied to the print head structure by the pump with the control valve in the closed state, and a fluid circulation mode, in which a second lower pressure is supplied to the print head structure by the pump with the control valve in the open state.

15. An ink jet printing apparatus including a print head structure as claimed in claim 14.

16. A primer apparatus as claimed in claim 1, wherein the primer apparatus has a priming mode, in which a first pressure is supplied to the print head structure by the pump with the control valve in a closed state, and a fluid circulation mode, in which a second lower pressure is supplied to the print head structure by the pump with the control valve in an open state.

17. A primer apparatus as claimed in claim 1, wherein the control valve comprises a normally-open solenoid valve.

18. A primer apparatus as claimed in claim 4, wherein the plug is maintained in the outlet valve by interference fit.

19. A primer apparatus as claimed in claim 4, wherein the plug is integrally moulded with the outlet valve.

20. A print head structure as claimed in claim 14, wherein the control valve comprises a normally-open solenoid valve.

* * * * *